US010488803B2

(12) United States Patent
Suzuki

(10) Patent No.: US 10,488,803 B2
(45) Date of Patent: Nov. 26, 2019

(54) TONER TRANSPORT MECHANISM AND IMAGE FORMING APPARATUS

(71) Applicant: CANON KABUSHIKI KAISHA, Tokyo (JP)

(72) Inventor: Yoshimi Suzuki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/291,546

(22) Filed: Mar. 4, 2019

(65) Prior Publication Data

US 2019/0196384 A1 Jun. 27, 2019

Related U.S. Application Data

(63) Continuation of application No. 15/944,073, filed on Apr. 3, 2018, now Pat. No. 10,261,457.

(30) Foreign Application Priority Data

Apr. 10, 2017 (JP) ..... 2017-077494

(51) Int. Cl.

| | |
|---|---|
| ***G03G 21/00*** | (2006.01) |
| ***G03G 21/12*** | (2006.01) |
| ***G03G 15/00*** | (2006.01) |
| ***G03G 15/08*** | (2006.01) |
| ***G03G 15/095*** | (2006.01) |
| ***G03G 21/10*** | (2006.01) |

(52) U.S. Cl.

CPC ..... *G03G 15/55* (2013.01); *G03G 15/0879* (2013.01); *G03G 15/095* (2013.01); *G03G 21/105* (2013.01); *G03G 21/12* (2013.01)

(58) Field of Classification Search

CPC .. G03G 15/55; G03G 15/095; G03G 15/0879; G03G 21/10; G03G 21/105; G03G 21/12; G03G 2221/1624

See application file for complete search history.

(56) References Cited

U.S. PATENT DOCUMENTS

| | | | |
|---|---|---|---|
| 8,249,471 | B2 | 8/2012 | Kawahara |
| 9,857,757 | B2 | 1/2018 | Inada et al. |
| 2004/0033094 | A1 | 2/2004 | Saito et al. |
| 2005/0220515 | A1 | 10/2005 | Wakana |
| 2010/0196021 | A1 | 8/2010 | Ohba et al. |
| 2014/0147165 | A1 | 5/2014 | Sakuma et al. |
| 2017/0336752 | A1 | 11/2017 | Inada et al. |

FOREIGN PATENT DOCUMENTS

| | | | |
|---|---|---|---|
| JP | 2009-063772 | A | 3/2009 |
| JP | 2010-237422 | A | 10/2010 |
| JP | 2011-033693 | A | 2/2011 |
| JP | 2017-021123 | A | 1/2017 |

*Primary Examiner* — Sophia S Chen
(74) *Attorney, Agent, or Firm* — Venable LLP

(57) ABSTRACT

Provided is a toner transport mechanism including: a first movable member which is displaced in accordance with an amount of toner in a transport path for transporting toner; a second movable member which is displaced in accordance with a rotation of a transporting member provided in the transport path; and a flag member which is displaced to an acting position where the flag member acts on a sensor and a non-acting position where the flag member does not act on the sensor, in accordance with the displacement of the first movable member and the displacement of the second movable member, the sensor being arranged outside of a duct and detecting an anomaly of the toner transport mechanism.

15 Claims, 9 Drawing Sheets

TONER TRANSPORT MECHANISM AND IMAGE FORMING APPARATUS

BACKGROUND OF THE INVENTION

Field of the Invention

The present invention relates to a toner transport mechanism used in an electrophotographic image forming apparatus.

Description of the Related Art

Image forming apparatuses, such as copiers, printers and facsimile machines, which form an image on recording material using an electrophotographic system may adopt a configuration in which toner such as untransferred toner having been generated in an image forming process and having become unnecessary without being transferred onto the recording material is transported to and stored in a recovery container. While transportation of unnecessary toner generally involves rotating a transporting member such as a screw or a spring installed on a transport path to transport the unnecessary toner to the recovery container, toner leakage sometimes occurs due to damage, an assembly error, or the like of the transporting member preventing the toner from being normally transported. Therefore, it is necessary to detect whether the transporting member is operating normally in order to prevent problems such as toner leakage from occurring. Meanwhile, problems occur in which toner accumulates on the transport path and toner clogging causes transportation failure, damage to parts, and the like despite the transporting member operating normally. In consideration thereof, mainly in order to manage a state of toner inside a recovery container, measures are taken which involve providing a flag member and a sensor on a downstream side on a toner transport path to detect a toner amount, as described in Japanese Patent Application Laid-open No. 2017-21123.

SUMMARY OF THE INVENTION

An unnecessary toner recovery mechanism described in Japanese Patent Application Laid-open No. 2017-21123 is configured such that, in order to detect a toner amount inside a recovery container, a flag member is provided on a downstream side of a transporting member in a toner transport direction and the flag member is pressed by unnecessary toner to trip a detection sensor. However, an apparatus configuration described in Japanese Patent Application Laid-open No. 2017-21123 represents a configuration which uses a large space inside the recovery container of unnecessary toner, and spatial constraints may arise when the apparatus configuration is to be provided at other locations. For example, when the same configuration is applied on the toner transport path with a smaller space than the recovery container, the configuration may inhibit the transportation of toner and may cause clogging. In addition, the configuration described in Japanese Patent Application Laid-open No. 2017-21123 is solely intended to detect a presence or absence of unnecessary toner, and separately providing failure detection of the transporting member described earlier requires that a sensor and a detecting member be respectively provided for unnecessary toner detection and failure detection, further increasing the number of parts and sizes of installation spaces. Furthermore, since there is a risk that penetration of toner into a detection sensor portion may cause erroneous detection, a component for sealing a space between the toner transport path and the detection sensor is generally provided. However, with the configuration described in Japanese Patent Application Laid-open No. 2017-21123, since a connecting portion between the flag member and the detection sensor is located in a toner transport region by the transporting member, there is a risk that toner may leak from the connecting portion and adhere to a detecting portion to impair detection accuracy.

An object of the present invention is to provide a technique capable of realizing anomaly detection and erroneous detection prevention of a toner transport mechanism with a simple configuration.

In order to achieve the object described above, a toner transport mechanism according to the present invention includes:

a duct which forms a transport path for transporting toner;

a transporting member which is provided in the transport path and which transports toner inside the transport path by rotating;

a sensor arranged outside of the duct;

a first movable member which is displaced in accordance with an amount of the toner inside the transport path;

a second movable member which is displaced in accordance with the rotation of the transporting member; and a flag member which is displaced to an acting position where the flag member acts on the sensor and to a non-acting position where the flag member does not act on the sensor, in accordance with the displacement of the first movable member and the displacement of the second movable member.

In order to achieve the object described above, a toner transport mechanism according to the present invention includes:

a duct which forms a transport path for transporting toner;

a transporting member which is provided in the transport path and which transports toner inside the transport path by rotating;

a sensor arranged outside of the duct; and a movable member which is displaced to an acting position where the movable member acts on the sensor and to a non-acting position where the movable member does not act on the sensor, in accordance with an amount of the toner inside the transport path, the movable member being arranged in an opening which is provided in the duct and which is positioned above the transporting member.

In order to achieve the object described above, an image forming apparatus according to the present invention includes:

an image forming portion which forms a toner image;

a duct which forms a transport path for transporting toner;

a transporting member which is provided in the transport path and which transports toner inside the transport path by rotating;

a sensor arranged outside of the duct;

a first movable member which is displaced in accordance with an amount of the toner inside the transport path;

a second movable member which is displaced in accordance with the rotation of the transporting member;

a flag member which is displaced to an acting position where the flag member acts on the sensor and to a non-acting position where the flag member does not act on the sensor, in accordance with the displacement of the first movable member and the displacement of the second movable member; and a control unit which detects an anomalous state when the acting state by the flag member lasts more than a prescribed period of time.

According to the present invention, anomaly detection and erroneous detection prevention of a toner transport mechanism can be realized with a simple configuration.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Hereinafter, a toner transport mechanism and an image forming apparatus provided with the toner transport mechanism according to an embodiment of the present invention will be described with reference to the drawings. Examples of image forming apparatuses to which the present invention is applicable include image forming apparatuses such as copiers, printers, and facsimile machines, which form an image on recording material using an electrophotographic system. In addition, while a transportation object of the toner transport mechanism is mainly untransferred residual toner (toner remaining on an image bearing member without being transferred to recording material or an intermediate transfer member or toner remaining on the intermediate transfer member without being secondarily transferred to recording material), transportation objects also include residual objects other than toner such as a scrap of paper and dust.

Figure 1:
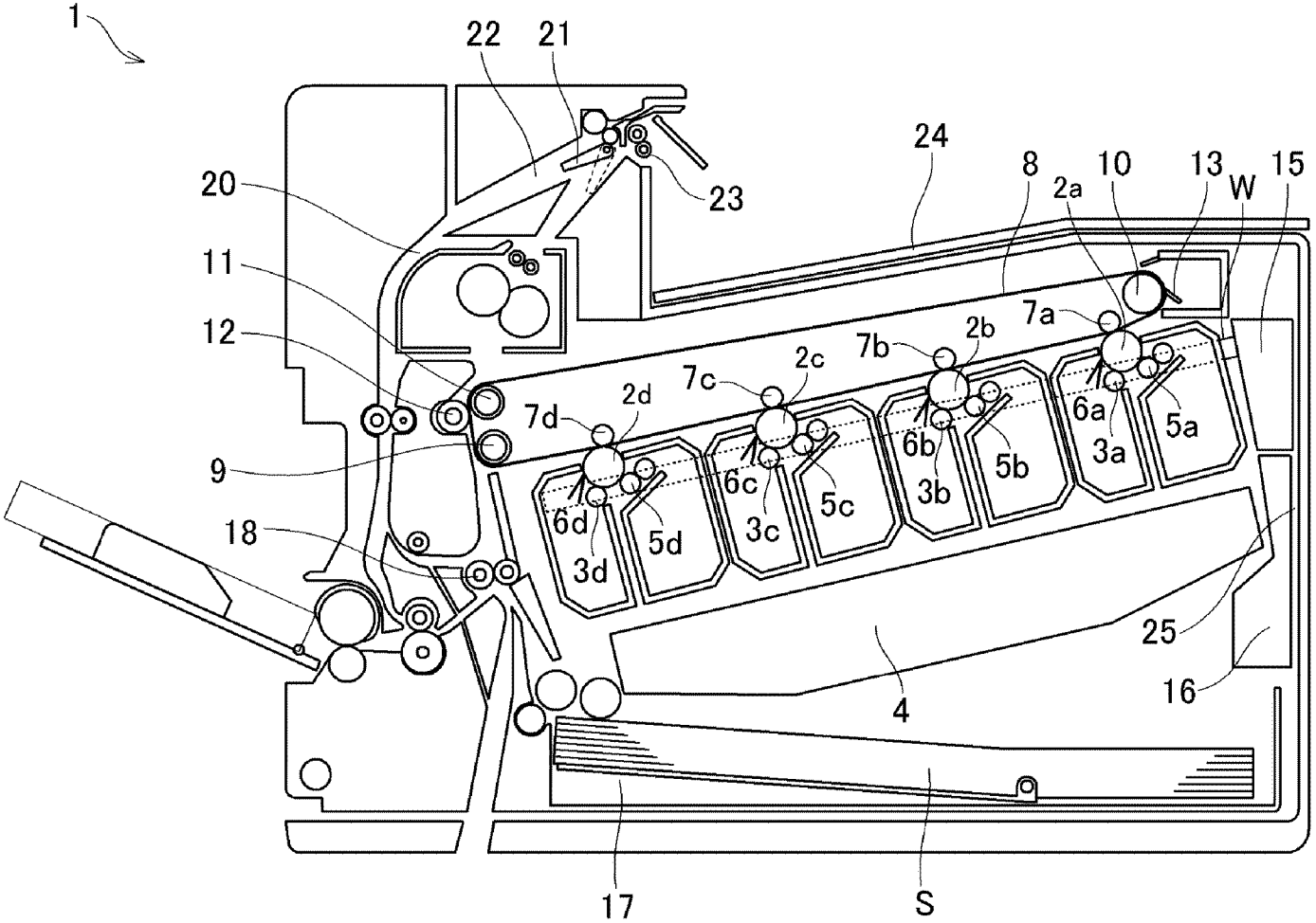
FIG. 1 is a schematic sectional view of an image forming apparatus according to an embodiment of the present invention.

FIG. 1 is a schematic sectional view showing a configuration of a color electrophotographic system image forming apparatus including the toner transport mechanism according to the present first embodiment. The image forming apparatus 1 includes four photosensitive drums 2 (2*a*, 2*b*, 2*c*, and 2*d*) which are drum-like photosensitive members as image bearing members. The photosensitive drum 2 is rotationally driven clockwise in the drawing by driving means (not shown). In addition, the image forming apparatus 1 includes charging apparatuses 3 (3*a*, 3*b*, 3*c*, and 3*d*) which uniformly charge a surface of the photosensitive drum 2 and a scanner unit 4 which irradiates a laser beam based on image information and which forms an electrostatic latent image on each photosensitive drum 2. Furthermore, the image forming apparatus 1 includes developing apparatuses 5 (5*a*, 5*b*, 5*c*, and 5*d*) which cause toner including a developer to adhere to the electrostatic latent image and develop the electrostatic latent image as a toner image (a developer image). In addition, the image forming apparatus 1 includes drum cleaning apparatuses 6 (6*a*, 6*b*, 6*c*, and 6*d*) which remove untransferred toner remaining on the surface of the photosensitive drum 2 after the toner image is transferred to a sheet (recording material) S. In this case, residual toner which cannot be stored in a process cartridge for the removed residual toner is transported to a toner delivery duct 15 by a toner transport mechanism W and recovered in a toner recovery container 16 from the toner delivery duct 15. For example, the toner transport mechanism W is constituted by a toner transport passage, a screw that rotates inside the toner transport passage, and the like, and is configured to be capable of transporting toner from each process cartridge to the toner delivery duct 15. In the image forming apparatus 1 according to the present embodiment, the photosensitive drum 2, the charging apparatus 3, the developing apparatus 5, and the cleaning apparatus 6 are configured as integrated cartridge units which respectively form images of different colors (yellow, cyan, magenta, and black) in accordance with an electrophotographic recording system.

Primary transfer rollers 7 (7*a*, 7*b*, 7*c*, and 7*d*) as transferring means are in contact with the photosensitive drum 2 via an intermediate transfer belt 8, and a toner image on the photosensitive drum 2 is transferred to the intermediate transfer belt 8. The intermediate transfer belt 8 is made taut between a driver roller 9, a tension roller 10, and a secondary transfer counter roller 11 and is rotated clockwise by driving of the driver roller 9. A secondary transfer roller 12 provided at a position opposing the secondary transfer counter roller 11 via the intermediate transfer belt 8 transfers the toner image having been transferred to the intermediate transfer belt 8 to the sheet S. In addition, at a position opposing the tension roller 10 via the intermediate transfer belt 8, a cleaning blade 13 as an intermediate transfer belt cleaning apparatus removes and recovers untransferred toner remaining on a surface of the intermediate transfer belt 8.

A paper feeding cassette 17 provided in a bottommost part of the apparatus and a resist roller pair 18 which corrects a skew of the sheet S are installed as feeding and transport means of the sheet S. Due to an image forming portion of each color, the toner image formed on the sheet S via the intermediate transfer belt 8 is fixed by fixing means 20. During one-side printing, the sheet S to which the toner image is fixed is guided to a discharge transport path 22 by a double flapper 21 as transport path switching means and discharged to a paper discharge tray 24 that is sheet stacking means by a paper discharge roller pair 23.

Next, an apparatus operation will be described. A prescribed number of the sheets S stacked in the paper feeding cassette 17 are separated one by one by a feeding roller, transported to a paper feeding/withdrawing roller and the resist roller pair 18, and transported to a contact region of the intermediate transfer belt 8 and the secondary transfer roller 12. A toner image transferred to the intermediate transfer belt 8 by the image forming portion of each color is transferred to the sheet S by the contact region of the intermediate transfer belt 8 and the secondary transfer roller 12 to form a color image and, subsequently, the sheet S is transported to the fixing means 20. At the fixing means 20, heat and pressure are applied to the toner images transferred to the sheet S. Accordingly, the sheet S to which toner images of a plurality of colors have been fixed is guided by the double flapper 21 to the discharge transport path 22, passes through the paper discharge roller pair 23, and is discharged to the paper discharge tray 24. A left door 25 can be opened and closed in order to replace the toner recovery container.

Figure 2:
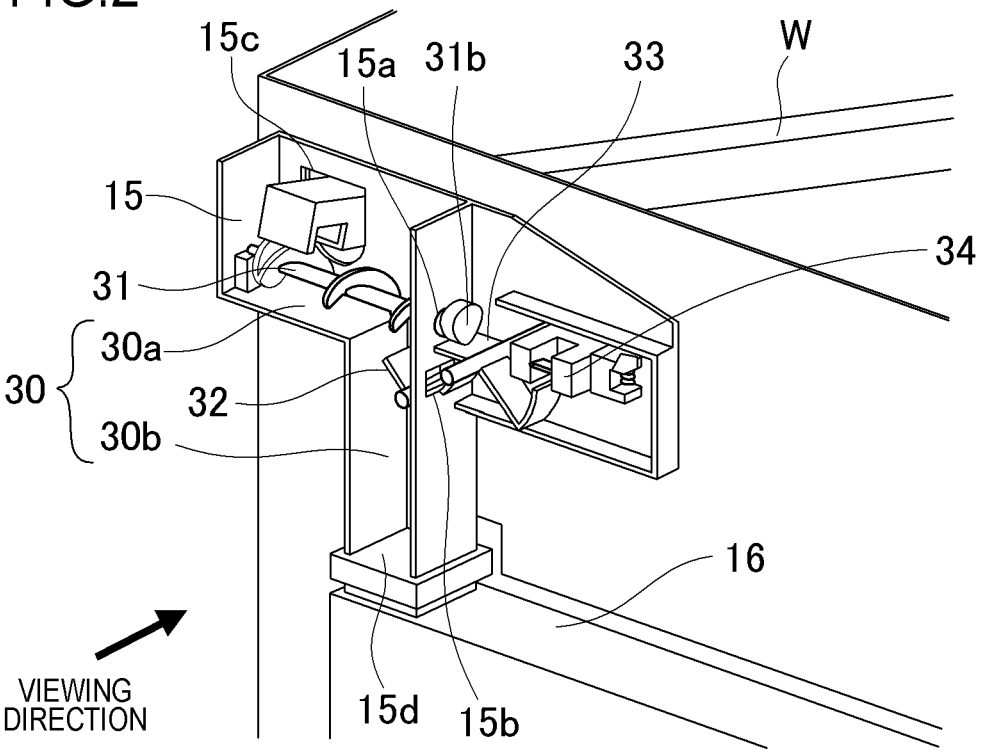
FIG. 2 is a schematic perspective view showing a configuration of a toner transport mechanism according to a first embodiment of the present invention.

A configuration of the toner transport mechanism according to the present first embodiment will be described with reference to FIG. 2 to FIGS. 5A and 5B. FIG. 2 is a schematic perspective sectional view capturing an overall picture of the toner transport mechanism in the image forming apparatus 1 according to the present embodiment, of which an internal structure has been made easily visible by removing a wall portion of the toner delivery duct 15, an outer wall cover of an apparatus main body, and the like on a near side (a side opposite to a direction of an arrow in the diagram). FIG. 3 to FIGS. 5A and 5B are schematic views presenting an enlarged internal section as viewed from the sagittal direction shown in FIG. 2. FIGS. 4A and 4B and FIGS. 5A and 5B are schematic views for explaining movements of respective components inside the toner delivery duct.

As shown in FIG. 2, the toner delivery duct 15 has a transport path 30 for transporting toner, and a transport screw 31 as a toner transporting member and a clogging detecting lever 32 as a first movable member are installed inside the transport path 30. In addition, the transport path 30 of the toner delivery duct 15 is constituted by a first transport path 30*a* on which toner is transported in an approximately horizontal direction by the transport screw 31 and a second transport path 30*b* which is positioned on a downstream side of the first transport path 30*a* and onto which toner free-falls. Furthermore, an intermediate sensor flag 33 and a detection sensor 34 that is an optical sensor are installed at a position never reached by deposited toner in a vicinity of the toner transport path 30. The toner delivery duct 15 includes: a shaft hole 15*a* through which the transport screw 31 is inserted; an opening 15*b* in which the clogging detecting lever 32 is arranged; an opening 15*c* which receives toner transported from the toner transport mechanism W; and an opening 15*d* which is communicated with the toner recovery container 16. While the toner delivery duct 15 is shown in the diagram with its interior opened, the interior with the exception of the shaft hole 15*a* and openings 15*b*, 15*c*, and 15*d* are covered by a wall and the toner transport path 30 with an approximately inverted L-shape is formed from the opening 15*c* to the opening 15*d*.

The transport screw 31 is capable of rotating in one direction as a driving force from a driving source (not shown) is transmitted thereto and, when the transport screw 31 rotates, a blade portion 31*a* of the transport screw 31 can push toner and transport the toner toward a downstream side in an approximately horizontal direction. The transport screw 31 has a cam portion 31*b* as a second movable member (cam member) at a shaft end on a downstream side in a toner transport direction. The intermediate sensor flag 33 as a flag member is constantly biased in a rotation direction in which a connecting portion (a second pressed portion) 33*d* comes into contact with the cam portion 31*b* by biasing means (not shown) such as a spring. In addition, the intermediate sensor flag 33 has an end flag-shaped portion 33*a* on a side opposite to, with a rotating shaft 33*c* at center, the connecting portion 33*d* connected to the cam portion 31*b* of the transport screw 31. The end flag-shaped portion 33*a* can be connected to the detection sensor 34.

The clogging detecting lever 32 is installed above the transport path 30*b*. The clogging detecting lever 32 has a toner pressed portion 32*a* and a lever portion 32*b* (first pressing portion), in which case the lever portion 32*b* is arranged on an opposite side to the toner pressed portion 32*a* across a rotating shaft 32*c*. The lever portion 32*b* is installed in a vicinity of the intermediate sensor flag 33 so as to be capable of pressing a pressed portion 33*b* of the intermediate sensor flag 33. The clogging detecting lever 32 is configured to be rotatable (displaceable) such that the lever portion 32*b* is displaced in the following manner. That is, in a normal state, the lever portion 32*b* is positioned at a standby position (a non-acting position where the lever portion 32*b* does not act on the detection sensor 34). In addition, when the toner pressed portion 32*a* is pushed upward in a rotation direction A by toner clogging, the lever portion 32*b* moves to a position where the lever portion 32*b* pushes the pressed portion 33*b* and causes the intermediate sensor flag 33 to rotate.

Figure 4A:
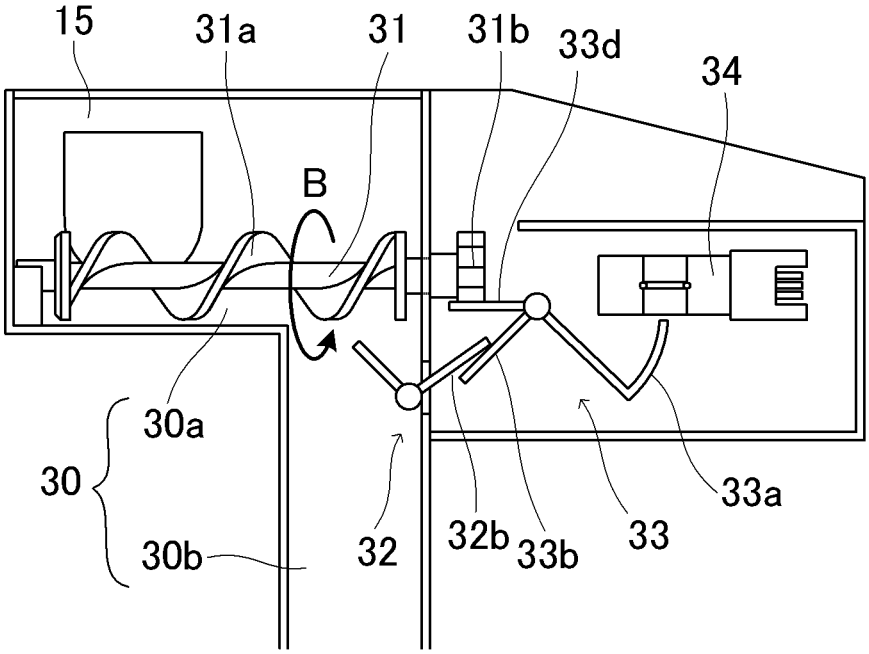
FIGS. 4A and 4B are explanatory diagrams of rotation detection of a toner transport mechanism according to the first embodiment of the present invention.
Figure 4B:
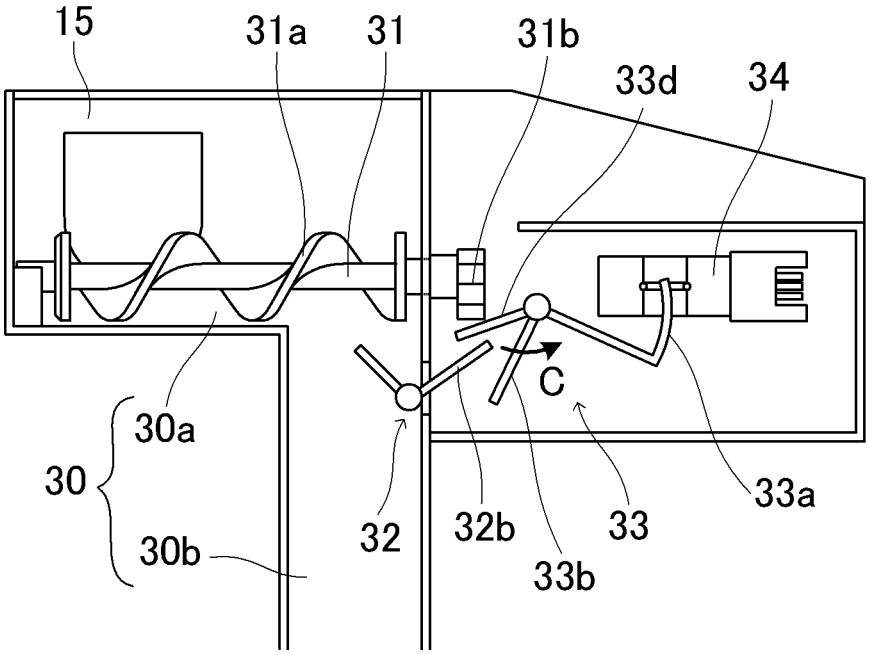

A movement of the transport screw 31 will be described with reference to FIGS. 4A and 4B. When receiving a rotational driving force from a driving source, the transport screw 31 rotates in a direction of an arrow B in FIG. 4A. When the transport screw 31 rotates in the direction of the arrow B, the cam portion 31*b* at the end also rotates in the direction of the arrow B and a contact position with the connecting portion 33*d* of the intermediate sensor flag 33 on an outer circumferential surface of the cam portion 31*b* changes. The cam portion 31*b* has a cam shape in which a radial dimension of an outer circumferential surface (a second pressing portion) that is a cam surface or, in other words, a distance from a center of rotation to the outer circumferential surface changes in a circumferential direction. Therefore, a change (an increase) in the distance between the contact region with the connecting portion 33*d* and the center of rotation due to rotation of the cam portion 31*b* causes the cam portion 31*b* to rotate the intermediate sensor flag 33 in a direction of an arrow C as shown in FIG. 4B. At this point, the end flag-shaped portion 33*a* of the intermediate sensor flag 33 is displaced to a light-shielding position (an acting portion) where detection light of the detection sensor 34 is shielded or, in other words, a position where an optical path between a light emitting portion and a light receiving portion in the detection sensor 34 is blocked. Subsequently, the transport screw 31 is further rotationally driven and, since the intermediate sensor flag 33 is biased by biasing means (not shown) such that the connecting portion 33*d* maintains a contact state with the cam portion 31*b*, the transport screw 31 and the intermediate sensor flag 33 once again return to positions shown in FIG. 4A. In other words, as long as the transport screw 31 continues to be rotationally driven, the intermediate sensor flag 33 periodically and repetitively alternates moving (being displaced) to the non-acting position shown in FIG. 4A and moving (being displaced) to the acting position shown in FIG. 4B.

At this point, the detection sensor 34 detects light shielding (non-light reception) and light transmission (light reception) by the end flag-shaped portion 33*a* of the intermediate sensor flag 33. In addition, when the transport screw 31 becomes immobile due to damage to or an assembly error of a component and the detection sensor 34 senses light shielding or light transmission for a certain period of time (when a non-light-receiving state (a non-acting state) or a light-receiving state (an acting state) lasts more than a prescribed threshold period), the detection sensor 34 detects an anomaly. When anomaly detection is reported from the detection sensor 34, a control unit of the image forming apparatus stops operation of the apparatus and displays a warning on a display portion (not shown) provided on the apparatus main body. In addition to the component damage and the faulty component assembly described above, conceivable causes of the detection of an anomaly include failure of respective components of a driving source that imparts a driving force to the transport screw 31, and even such failures can be detected with the present detection configuration.

Figure 11:
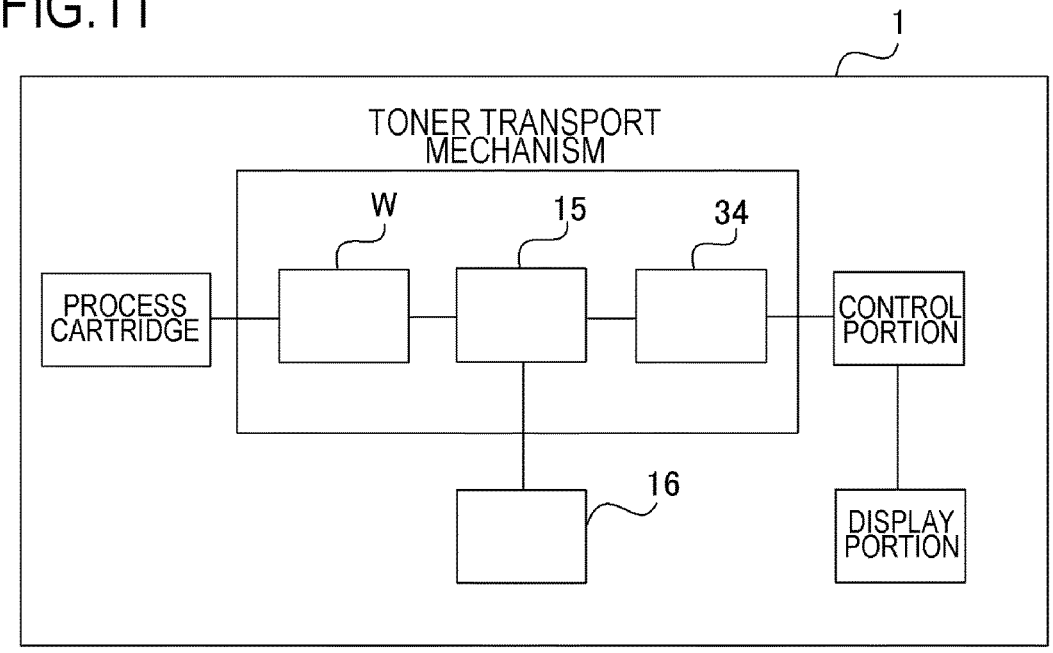
FIG. 11 is a schematic diagram of an image forming apparatus and a toner transport mechanism according to the first embodiment of the present invention.

FIG. 11 is a schematic diagram of the image forming apparatus and toner transport mechanism according to the present embodiment. As shown in FIG. 11, a configuration according to the present embodiment including the toner transport mechanism W, the toner delivery duct 15, and the detection sensor 34 corresponds to the toner transport mechanism according to the present invention. By the toner transport mechanism with the above configuration, toner is transported from the image forming portion which includes the above mentioned process cartridge into the toner recovery container. The control unit of the image forming apparatus 1 performs a reporting action for a user which includes displaying information for reporting an anomalous state on the display portion, as a reporting unit, of an operation panel of the apparatus, making an alarm sound for the warning, and so on.

In other words, in failure detecting means according to the present embodiment, the cam portion 31*b* is a component for transmitting and inputting a state of rotation of the transport screw 31 to the detection sensor 34. In addition, the clogging detecting lever 32 is a component for transmitting and inputting a state of circulation (a state of deposition) of toner inside the toner transport path formed by the toner delivery duct 15 to the detection sensor 34. The failure detecting means according to the present embodiment is configured such that both the cam portion 31*b* and the clogging detecting lever 32 input respective state changes thereof to the detection sensor 34 via the intermediate sensor flag 33. In other words, the intermediate sensor flag 33 doubles as a component for inputting the state of rotation of the transport screw 31 into the detection sensor 34 and a component for inputting the state of circulation (the state of deposition) of toner inside the toner delivery duct 15 to the detection sensor 34.

Seal Configuration

The toner transport mechanism according to the present embodiment adopts a seal configuration described below in order to prevent false detection by the failure detecting means or, more specifically, to prevent toner from adhering to the detection sensor 34 and affecting detection accuracy.

First, the detection sensor 34 is arranged outside of the toner delivery duct 15. In other words, in the configuration of the failure detecting means, the detection sensor 34 which is a component that desirably does not come into contact with toner is arranged outside of a transport path for transporting toner. On the other hand, in the configuration for transmitting and inputting a state inside the toner delivery duct 15 to the detection sensor 34, the shaft of the transport screw 31 which supports the cam portion 31*b* and the clogging detecting lever 32 are arranged so as to straddle the inside and outside of the toner delivery duct 15.

In addition, a space between the transport screw 31 which extends so as to straddle the inside and outside of the toner delivery duct 15 and a wall of the toner delivery duct 15 is sealed. Specifically, for example, it is conceivable to minimize a dimensional difference between the shaft of the transport screw 31 and the shaft hole 15*a* of the toner delivery duct 15 or to provide an annular seal member which slides with the transport screw 31 between the shaft of the transport screw 31 and the shaft hole 15*a*. Alternatively, a configuration may be adopted so that a shaft diameter of the transport screw 31 increases on an outer side (a side on which the cam portion 31*b* is provided) with respect to a location inserted into the shaft hole 15*a* to reduce leakage of toner from the shaft hole 15*a* to the outside. Accordingly, toner transported inside the toner delivery duct 15 by the transport screw 31 is prevented from penetrating, via the shaft hole 15*a*, into a space in which is arranged the detection sensor 34 that is the outside the toner delivery duct 15.

Furthermore, the clogging detecting lever 32 is arranged so as to straddle the inside and outside of the toner delivery duct 15 via the opening 15*b* which is positioned below the detection sensor 34. Although there is a possibility that transported toner may leak out from the opening 15*b*, since the detection sensor 34 is positioned above the opening 15*b*, leaked toner is unlikely to reach the detection sensor 34.

In addition, the intermediate sensor flag 33 is present between the opening 15*b* and the detection sensor 34. Therefore, even if toner leaks out from the opening 15*b*, the toner is blocked by the intermediate sensor flag 33 and cannot readily reach the detection sensor 34.

Figure 3:
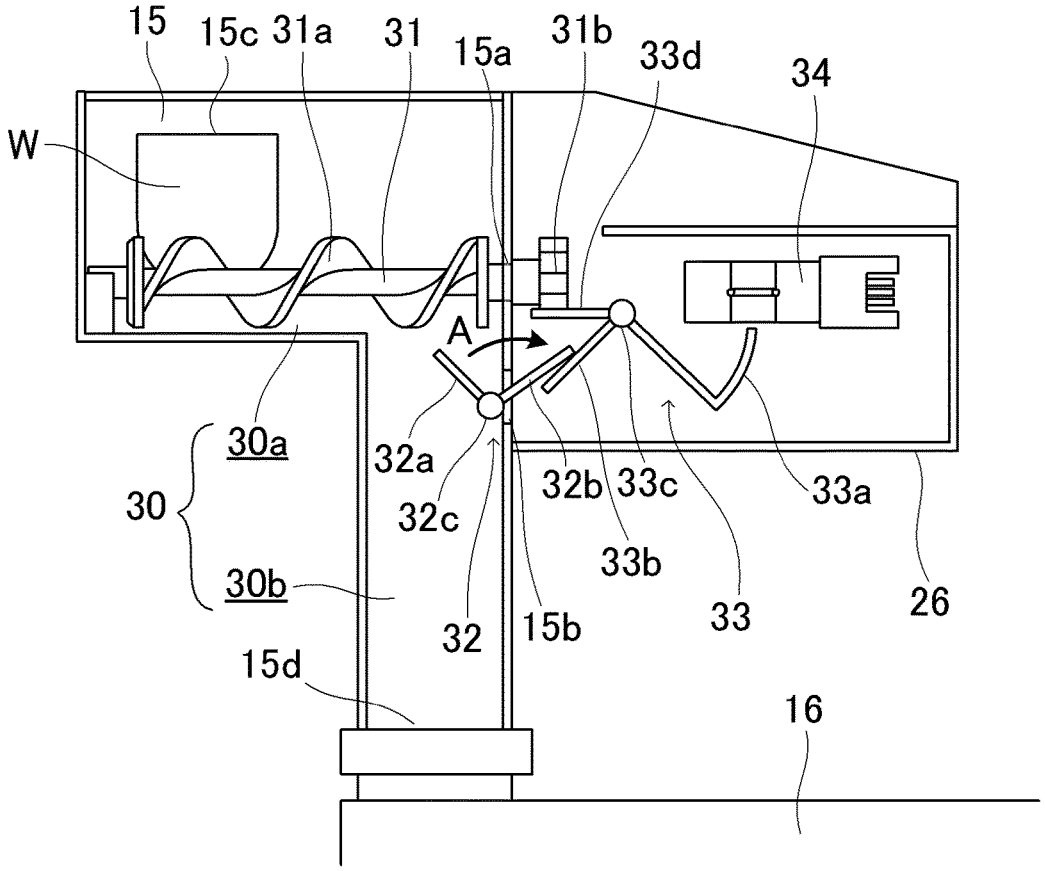
FIG. 3 is a schematic detailed explanatory diagram of a toner transport mechanism according to the first embodiment of the present invention.
Figure 8:
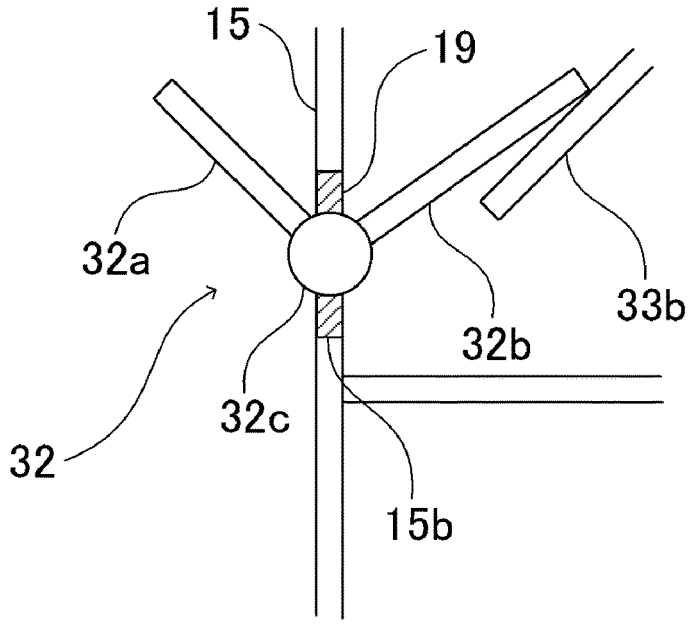
FIG. 8 is a schematic sectional view of a seal configuration according to a modification of the first embodiment of the present invention.

FIG. 8 is a schematic sectional view for explaining a seal configuration according to a modification of the first embodiment. In a situation where toner leakage from the opening 15*b* affects detection by the detection sensor 34, it is conceivable that the clogging detecting lever 32 is already in operation (there is a situation where the clogging detecting lever 32 should operate). Therefore, as shown in FIG. 3 and the like, it is conceivable that a configuration in which a seal is not provided between the opening 15*b* and the clogging detecting lever 32 may be adopted without much hindrance. However, as shown in FIG. 8, prevention of false detection by the detection sensor 34 may be enhanced by aligning a position of the rotating shaft 32*c* of the clogging detecting lever 32 with the opening 15*b* and sealing a space between the rotating shaft 32*c* and the opening 15*b* with a seal member 19 which comes into sliding contact with the rotating shaft 32*c*.

Figure 9:
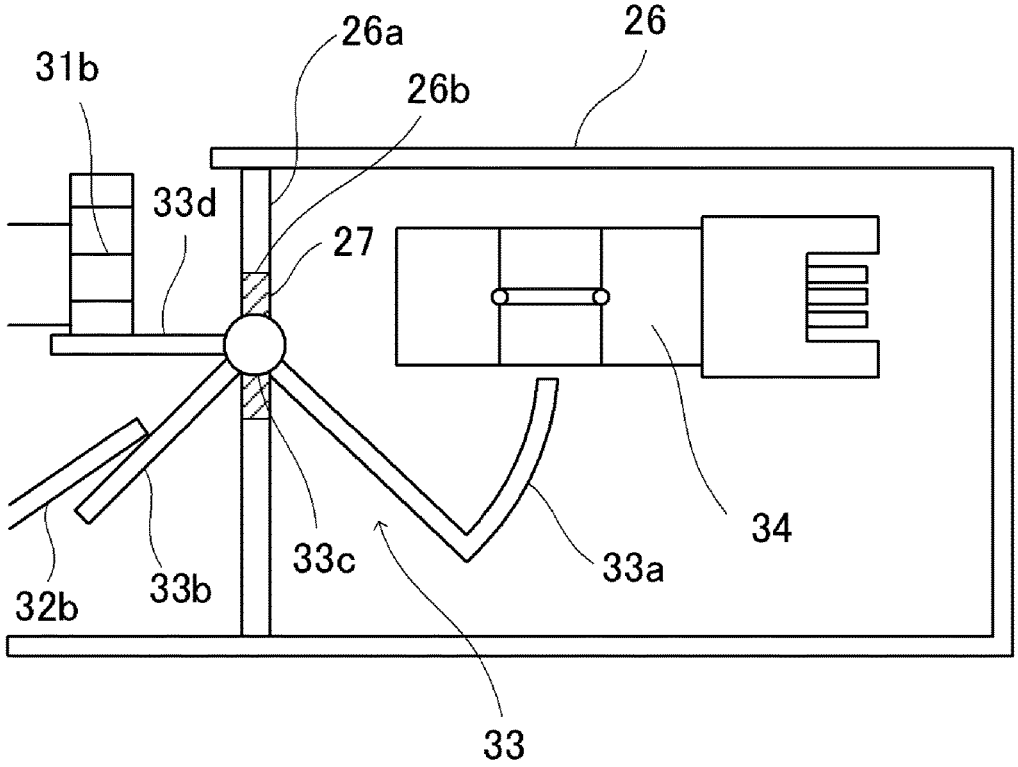
FIG. 9 is a schematic sectional view of a seal configuration according to a modification of the first embodiment of the present invention.

FIG. 9 is a schematic sectional view for explaining a seal configuration according to another modification of the first embodiment. A configuration shown in FIG. 9 may be adopted in order to further enhance prevention of false detection by the detection sensor 34. Specifically, a wall 26*a* may be added so as to demarcate a housing space for a sensor housing portion 26 with the rotating shaft 33*c* of the intermediate sensor flag 33 as a boundary, and a seal member 27 which comes into sliding contact with the rotating shaft 33*c* may be provided between an opening 26*b* of the wall 26*a* and the rotating shaft 33*c*. According to this configuration, particularly, toner having leaked outside of the toner delivery duct 15 can be effectively prevented from going over the seal between the shaft of the transport screw 31 and the shaft hole 15*a* of the toner delivery duct 15 and reaching the detection sensor 34.

Figure 5A:
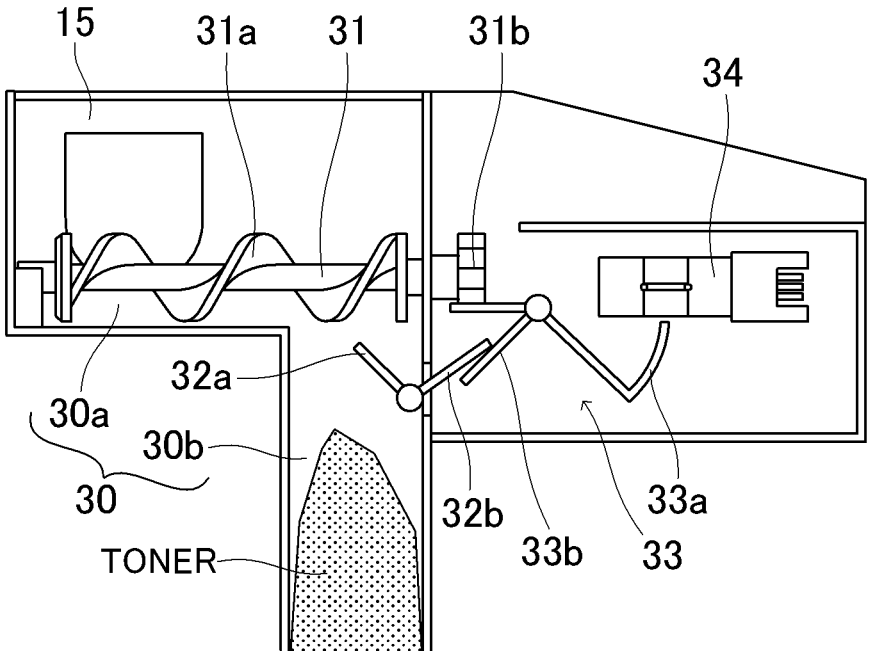
FIGS. 5A and 5B are explanatory diagrams of toner clogging detection of a toner transport mechanism according to the first embodiment of the present invention.
Figure 5B:
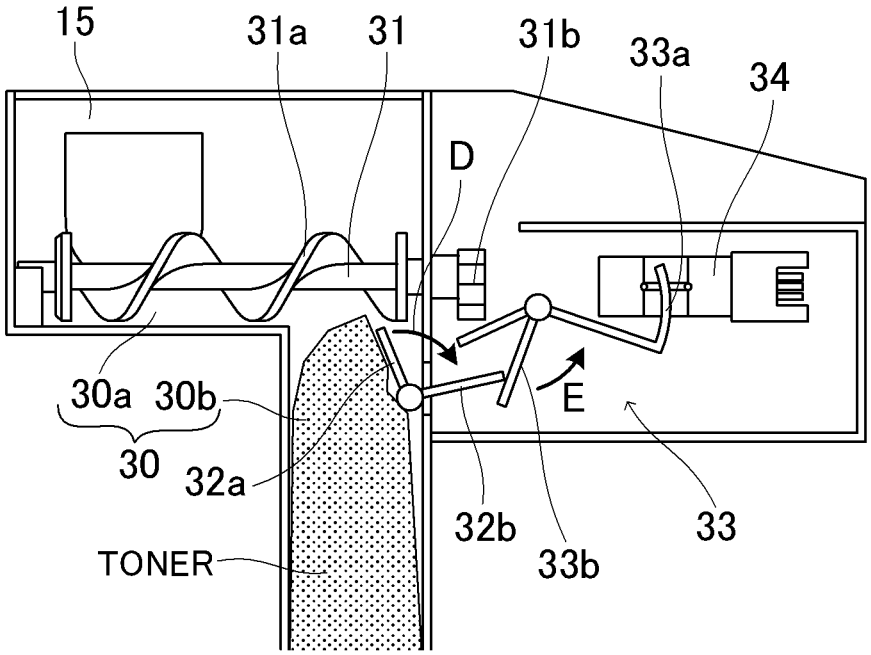

A movement of the clogging detecting lever 32 will be described with reference to FIGS. 5A and 5B. Normally, the clogging detecting lever 32 is fixed at a position shown in FIG. 5A. There may be cases where the transport path becomes clogged due to a defect of the toner recovery container 16 or the like on a downstream side of the clogging detecting lever 32 and the toner accumulates upward. In such a case, the toner pressed portion 32*a* of the clogging detecting lever 32 is pushed by the toner and, as shown in FIG. 5B, the clogging detecting lever 32 rotates toward a side of an arrow D around the rotating shaft 32*c* and moves to a clogging detection position. Once the clogging detecting lever 32 moves to the clogging detection position, the lever portion 32*b* of the clogging detecting lever 32 connects with the pressed portion 33*b* of the intermediate sensor flag 33 and moves the intermediate sensor flag 33 in a direction of an arrow E. Once the intermediate sensor flag 33 moves to the position shown in FIG. 5B, the end flag-shaped portion 33*a* of the intermediate sensor flag 33 moves to a light-shielding position of the detection sensor 34 and the detection sensor 34 detects light shielding. As described earlier, the detection sensor 34 is controlled so as to detect light shielding and light transmission by the end flag-shaped portion 33*a* of the intermediate sensor flag 33 and to detect an anomaly upon detecting light shielding (or light transmission) for a prescribed period of time.

Once the clogging detecting lever 32 and the intermediate sensor flag 33 are moved by toner clogging to the light-shielding position of the detection sensor 34 shown in FIG. 5B, the clogging detecting lever 32 and the intermediate sensor flag 33 do not further move from the position regardless of operations and a position of the transport screw 31. Therefore, the transport screw 31 and the clogging detecting lever 32 can move to the light-transmitting position and the light-shielding position of the detection sensor 34 without obstructing each other's movement.

As described above, a configuration is adopted in which the transport screw 31 and the clogging detecting lever 32 are installed inside the toner delivery duct 15 and the detection sensor 34 capable of detecting movements of the transport screw 31 and the clogging detecting lever 32 is installed outside of the toner delivery duct 15. Accordingly, the movement of the transport screw 31 and clogging of the toner transport path 30 can be detected by one sensor.

Moreover, an application range of the toner transport mechanism according to the present invention is not limited to the toner delivery duct of a color laser beam printer described in the present embodiment. The toner transport mechanism according to the present invention can be applied to various configurations in an image forming apparatus as long as similar components can be installed in a transport path for transporting powder.

Second Embodiment

A toner transport mechanism and an image forming apparatus according to a second embodiment of the present invention will be described with reference to FIG. 6 and FIGS. 7A and 7B. In a configuration of the image forming apparatus according to the second embodiment, since components other than the toner delivery duct in the toner transport path are the same as those in the first embodiment, a description thereof will be omitted. In the components of the toner delivery duct according to the second embodiment, characteristic portions that differ from the first embodiment will be mainly described.

Figure 6:
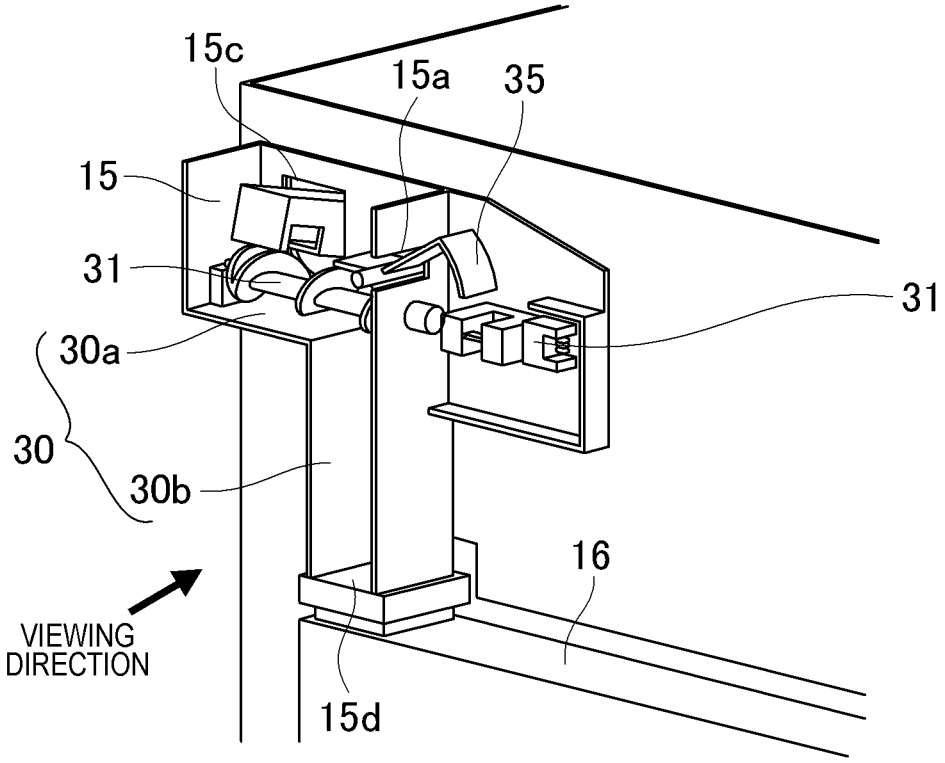
FIG. 6 is a schematic perspective view showing a configuration of a toner transport mechanism according to a second embodiment of the present invention.

FIG. 6 is a schematic perspective sectional view capturing an overall picture of the toner transport mechanism according to the second embodiment of the present invention, of which an internal structure has been made easily visible by removing a wall portion of the toner delivery duct 15, an outer wall cover of the apparatus main body, and the like on a near side (a side opposite to a direction of an arrow in the diagram).

Figure 7A:
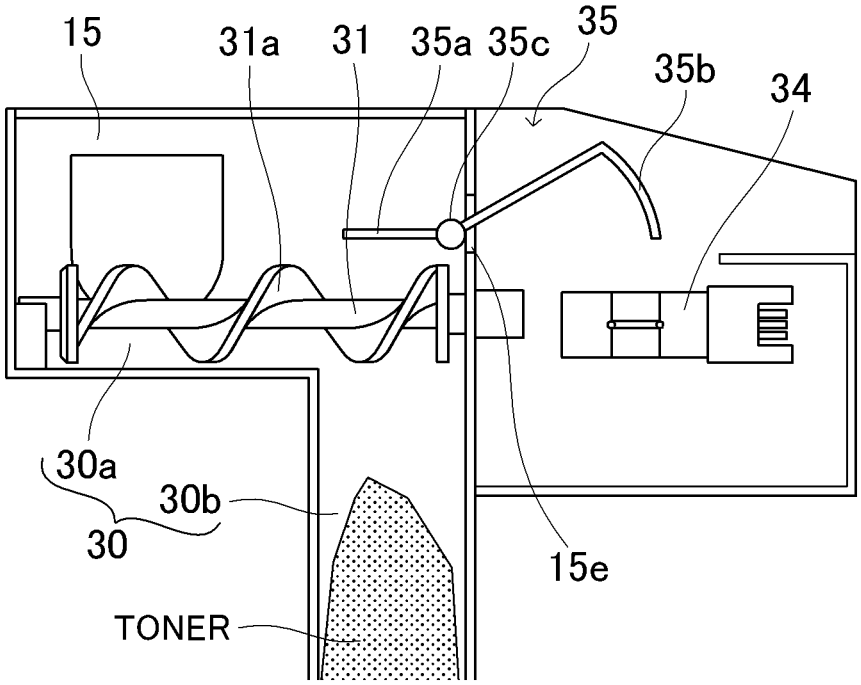
FIGS. 7A and 7B are explanatory diagrams of toner clogging detection of a toner transport mechanism according to the second embodiment of the present invention.
Figure 7B:
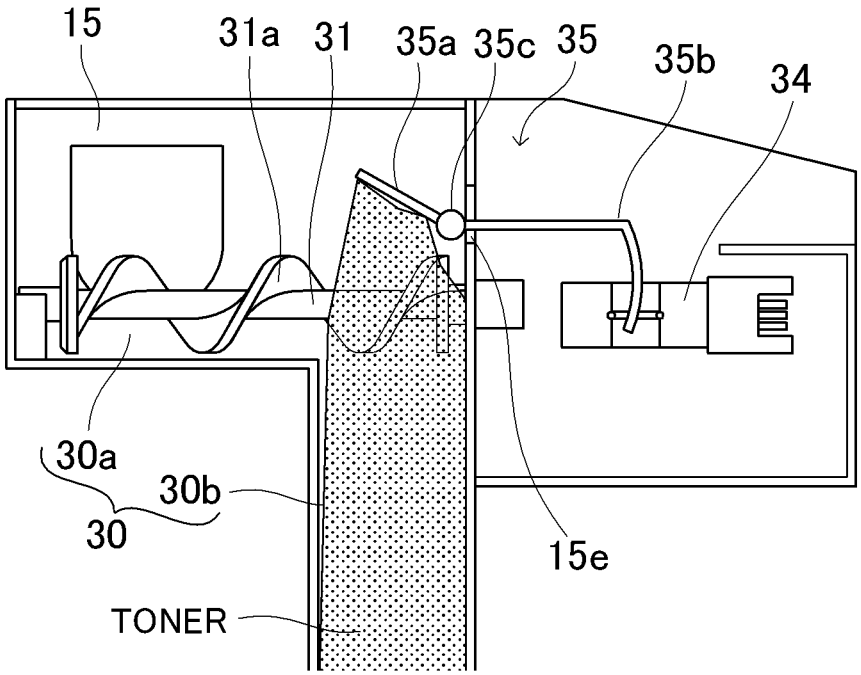

FIGS. 7A and 7B are schematic views presenting an enlarged internal section as viewed from the sagittal direction shown in FIG. 6 for explaining movements of respective components inside the toner delivery duct 15.

As shown in FIG. 6, the toner delivery duct 15 has the transport path 30 for transporting toner, and the transport screw 31 and a clogging detecting lever 35 are installed inside the transport path 30. In addition, the transport path 30 of the toner delivery duct 15 is constituted by a transport path 30*a* on which toner is transported in an approximately horizontal direction by the transport screw 31 and a transport path 30*b* which is positioned on a downstream side of the transport path 30*a* and onto which toner free-falls. The toner delivery duct 15 includes: the shaft hole 15*a* through which the transport screw 31 is inserted; the opening 15*c* which receives toner transported from the toner transport mechanism W; the opening 15*d* which is communicated with the toner recovery container 16; and an opening 15*e* in which the clogging detecting lever 35 is arranged. While the toner delivery duct 15 is shown in the diagram with its interior opened, the interior with the exception of the shaft hole 15*a* and the openings 15*c*, 15*d*, and 15*e* are covered by a wall and the toner transport path 30 with an approximately inverted L-shape is formed from the opening 15*c* to the opening 15*d*.

The transport screw 31 is capable of rotating in one direction as a driving force from a driving source (not shown) is transmitted thereto and, when the transport screw 31 rotates, the blade portion 31*a* of the transport screw 31 can push toner and transport the toner toward a downstream side in an approximately horizontal direction.

At a connecting portion of the transport path 30*a* and the transport path 30*b*, the clogging detecting lever 35 is installed above the transport screw 31. The clogging detecting lever 35 has a toner pressed portion 35*a* and a flag-shaped lever portion (a flag portion) 35*b*, and is provided in the toner delivery duct 15 so as to be rotatable around a rotating shaft 35*c*.

A movement of the clogging detecting lever 35 will be described with reference to FIGS. 7A and 7B.

As shown in FIG. 7A, during normal use in which toner is transported normally, the clogging detecting lever 35 is at a retracted position outside a region in which toner is transported. In other words, in a state where toner is being transported normally, with the exception of scattering or floating toner, most of the toner transported by a rotation of the transport screw 31 is transported by the transport path 30*a* in a region in which the transport screw 31 rotates. This means that the clogging detecting lever 35 arranged above the transport screw 31 is at a position deviated from a transport region of toner. In a state where the clogging detecting lever 35 is at the retracted position, as toner is transported in the transport path 30 by the transport screw 31, the clogging detecting lever 35 does not obstruct movement of the toner.

As shown in FIG. 7B, there are cases where the transport path 30*b* becomes clogged due to a defect of the toner recovery container 16 or the like on a downstream side of the clogging detecting lever 35 and the toner accumulates upward. In such a case, the toner pressed portion 35*a* of the clogging detecting lever 35 is pushed by the toner and rotates around the rotating shaft 35*c*. The lever portion 35*b* of the clogging detecting lever 35 is installed so as to be positioned in a vicinity of the detection sensor 34. The clogging detecting lever 35 is installed so as to maintain, in a normal state, a rotation phase in which the lever portion 35*b* is at a light-transmitting position of the detection sensor 34 (a non-light-shielding position where detection light of the detection sensor 34 is not shielded). When the toner pressed portion 35*a* is pushed up in a direction of an arrow A due to toner clogging on the downstream side, the clogging detecting lever 35 rotates so as to move the lever portion 35*b* to a light-shielding position where detection light of the detection sensor 34 is shielded as shown in FIG. 7B. Once the rotation phase where the lever portion 35*b* is at the light-shielding position is assumed, the clogging detecting lever 35 does not move from the position (the rotation phase) unless the deposited toner is removed.

The detection sensor 34 is controlled so as to detect an anomaly when a state where light is shielded by the lever portion 35*b* of the clogging detecting lever 35 (a non-light-receiving state in which the light receiving unit does not receive detection light) continues for a certain period of time (lasts more than a prescribed threshold period). Even in a state where toner is being transported normally, depending on an amount of transported toner, it is conceivable that the toner pressed portion 35*a* may be pushed by toner and the clogging detecting lever 35 may rotate, thereby causing the lever portion 35*b* to move to the light-shielding position instantaneously or for an extremely short period of time. The configuration of detecting an anomaly when the light-shielding state continues for a certain period of time or more is adopted in order to prevent such irregular light-shielding states from being erroneously detected as anomalies.

Seal Configuration

The toner transport mechanism according to the present embodiment adopts a seal configuration described below in order to prevent false detection by the failure detecting means or, more specifically, to prevent toner from adhering to the detection sensor 34 and affecting detection accuracy.

First, the detection sensor 34 is arranged outside of the toner delivery duct 15. In other words, in the configuration of the failure detecting means, the detection sensor 34 which is a component that desirably does not come into contact with toner is arranged outside of a transport path for transporting toner.

In addition, the clogging detecting lever 35 is arranged so as to straddle the inside and outside of the toner delivery duct 15 via the opening 15*e* which is positioned above the transport screw 31. The opening 15*e* is positioned above the transport screw 31 and most of the toner transported by a rotation of the transport screw 31 moves below the opening 15*e*. In other words, the opening 15*e* is provided in a region where movement of toner does not occur during normal toner transportation. Since a gap is provided between the opening 15*e* and the clogging detecting lever 35 to ensure that movement of the clogging detecting lever 35 is not obstructed, there is a possibility that a part of the transported toner may scatter or float and leak out via the opening 15*e*. However, the amount of toner which leaks out in such a manner is minimal, and in a situation where toner leakage from the opening 15*e* affects detection by the detection sensor 34, it is conceivable that the clogging detecting lever 35 is already in operation (there is a situation where the clogging detecting lever 35 should operate). Furthermore, since the clogging detecting lever 35 is arranged in the opening 15*e*, even if a part of the transported toner scatters or floats, the toner is blocked by the clogging detecting lever 35 and is prevented from readily reaching the detection sensor 34. Therefore, a gap provided between the opening 15*e* and the clogging detecting lever 35 is not a hindrance and both failure detection and false detection prevention can be realized with a simple configuration.

Figure 10:
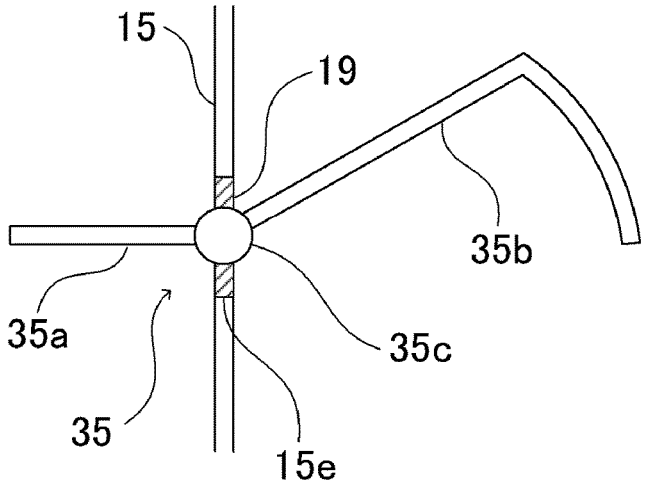
FIG. 10 is a schematic sectional view of a seal configuration according to a modification of the second embodiment of the present invention.

FIG. 10 is a schematic sectional view for explaining a seal configuration according to a modification of the second embodiment. A configuration shown in FIG. 10 may be adopted in order to further enhance prevention of false detection by the detection sensor 34. Specifically, prevention of false detection by the detection sensor 34 may be enhanced by aligning a position of the rotating shaft 35*c* of the clogging detecting lever 35 with the opening 15*e* and sealing a space between the rotating shaft 35*c* and the opening 15*e* with the seal member 19 which comes into sliding contact with the rotating shaft 35*c*.

As described above, the clogging detecting lever 35 is installed at a located separated from a transport direction inside the toner delivery duct 15 in which a transport direction of the transport path 30 changes midway, and the detection sensor 34 capable of detecting the clogging detecting lever 35 is installed outside of the toner delivery duct 15. Accordingly, a situation where toner adheres to the detection sensor 34 and impairs detection accuracy can be prevented and, at the same time, a size and the number of components of a seal member can be kept at a minimum.

Moreover, an application range of the toner transport mechanisms according to the present invention is not limited to the toner delivery duct of the color laser beam printer described in the present embodiment. The toner transport mechanisms according to the present invention can be applied to various configurations in an image forming apparatus as long as similar components can be installed in a transport path for transporting powder.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-077494, filed on Apr. 10, 2017, which is hereby incorporated by reference herein in its entirety.

What is claimed is:

1. A toner transport mechanism, comprising:

a duct which forms a transport path for transporting toner;

a transporting member which is provided in the transport path and which transports toner inside the transport path by rotating;

a sensor arranged outside of the duct;

a first movable member which is moved in accordance with an amount of the toner inside the transport path;

a second movable member which is moved in accordance with the rotation of the transporting member; and a flag member which is moved to an acting position where the flag member acts on the sensor and to a non-acting position where the flag member does not act on the sensor when being pressed by the second movable member, the flag member being positioned in either one of the acting position and the non-acting position by contact with the first movable member being moved by the toner, regardless of the movement of the second movable member.

2. The toner transport mechanism according to claim 1, wherein the first movable member has a pressing portion which presses the flag member so as to move the flag member from the non-acting position to the acting position when an amount of toner deposited in the transport path exceeds a prescribed amount.

3. The toner transport mechanism according to claim 2, wherein the transport path is comprised of a first transport path which extends approximately horizontally, and a second transport path which extends downward from a downstream side of the first transport path, and the first movable member: (i) has, in the second transport path, a pressed portion which is pressed by toner deposited in the second transport path; (ii) has the pressing portion outside of the duct; and (iii) rotates so as to create a state where the pressing portion presses the flag member when the pressed portion is pressed by the toner.

4. The toner transport mechanism according to claim 1, wherein the first movable member is arranged in an opening which is provided in the duct and which is positioned below the sensor.

5. The toner transport mechanism according to claim 1, wherein the second movable member has a pressing portion which presses the flag member so as to alternately and periodically move the flag member to the acting position and the non-acting position while the transporting member is rotating.

6. The toner transport mechanism according to claim 5, wherein the transport path is comprised of a first transport path which extends approximately horizontally, and a second transport path which extends downward from a downstream side of the first transport path, the transporting member is a screw which extends along the first transport path, and the second movable member: (i) is a cam member provided at an end of a shaft of the screw which extends to the outside of the duct on the downstream side of the first transport path; (ii) includes a cam surface serving as the pressing portion; and (iii) rotates due to rotation of the screw.

7. The toner transport mechanism according to claim 1, wherein the sensor is an optical sensor, and the flag member is moved to a position where detection light of the optical sensor is shielded as the acting position and to a position where the detection light is not shielded as the non-acting position.

8. An image forming apparatus, comprising:

an image forming portion which forms a toner image;

a duct which forms a transport path for transporting toner;

a transporting member which is provided in the transport path and which transports toner inside the transport path by rotating;

a sensor arranged outside of the duct;

a first movable member which is moved in accordance with an amount of the toner inside the transport path;

a second movable member which is moved in accordance with the rotation of the transporting member;

a flag member which is moved to an acting position where the flag member acts on the sensor and to a non-acting position where the flag member does not act on the sensor when being pressed by the second movable member, the flag member being positioned in either one of the acting position and the non-acting position by contact with the first movable member being moved by the toner, regardless of movement of the second movable member; and a control unit which detects an anomalous state when an acting state by the flag member lasts longer than a prescribed period of time.

9. The image forming apparatus according to claim 8, wherein the control unit outputs information for reporting an anomaly when detecting the anomalous state.

10. The image forming apparatus according to claim 8, wherein the first movable member has a pressing portion which presses the flag member so as to move the flag member from the non-acting position to the acting position when an amount of toner deposited in the transport path exceeds a prescribed amount.

11. The image forming apparatus according to claim 10, wherein the transport path is comprised of a first transport path which extends approximately horizontally, and a second transport path which extends downward from a downstream side of the first transport path, and the first movable member: (i) has, in the second transport path, a pressed portion which is pressed by toner deposited in the second transport path; (ii) has the pressing portion outside of the duct; and (iii) rotates so as to create a state where the pressing portion presses the flag member when the pressed portion is pressed by the toner.

12. The image forming apparatus according to claim 8, wherein the first movable member is arranged in an opening which is provided in the duct and which is positioned below the sensor.

13. The image forming apparatus according to claim 8, wherein the second movable member has a pressing portion which presses the flag member so as to alternately and periodically move the flag member to the acting position and the non-acting position while the transporting member is rotating.

14. The image forming apparatus according to claim 13, wherein the transport path is comprised of a first transport path which extends approximately horizontally, and a second transport path which extends downward from a downstream side of the first transport path, the transporting member is a screw which extends along the first transport path, and the second movable member: (i) is a cam member provided at an end of a shaft of the screw which extends to the outside of the duct on a downstream side of the first transport path; (ii) includes a cam surface serving as the pressing portion; and (iii) rotates due to rotation of the screw.

15. The image forming apparatus according to claim 8, wherein the sensor is an optical sensor, and the flag member is moved to a position where detection light of the optical sensor is shielded as the acting position and to a position where the detection light is not shielded as the non-acting position.

* * * * *